US007477272B2

(12) United States Patent
Baek et al.

(10) Patent No.: US 7,477,272 B2
(45) Date of Patent: Jan. 13, 2009

(54) NORMAL MODE DRIVING METHOD IN WIDE MODE LIQUID CRYSTAL DISPLAY DEVICE

(75) Inventors: Jung Sang Baek, Kyongsangbuk-do (KR); Sun Young Kwon, Kyongsangbuk-do (KR)

(73) Assignee: LG Display Co., Ltd., Seoul (KR)

( * ) Notice: Subject to any disclaimer, the term of this patent is extended or adjusted under 35 U.S.C. 154(b) by 753 days.

(21) Appl. No.: 10/740,465

(22) Filed: Dec. 22, 2003

(65) Prior Publication Data

US 2004/0150601 A1 Aug. 5, 2004

(30) Foreign Application Priority Data

Dec. 31, 2002 (KR) ..... 10-2002-0087783

(51) Int. Cl.
*G09G 5/02* (2006.01)

(52) U.S. Cl. ..... 345/698; 345/98; 345/99; 348/556

(58) Field of Classification Search ..... 345/698, 345/98–100, 87; 348/556
See application file for complete search history.

(56) References Cited

U.S. PATENT DOCUMENTS 6,128,045 A 10/2000 Anai et al.
6,362,804 B1 * 3/2002 Park et al. ..... 345/99
6,377,251 B1 * 4/2002 Takasu et al. ..... 345/204
6,721,009 B1 * 4/2004 Iizuka ..... 348/314

FOREIGN PATENT DOCUMENTS

| | | |
|---|---|---|
| JP | 8-289232 | 11/1996 |
| JP | 10-143106 | 5/1998 |
| JP | 10-171413 | 6/1998 |
| JP | 10-232645 | 9/1998 |
| JP | 10-327374 | 12/1998 |
| JP | 2001-242841 | 9/2001 |

* cited by examiner

*Primary Examiner*—Sumati Lefkowitz
*Assistant Examiner*—Seokyun Moon
(74) *Attorney, Agent, or Firm*—Birch, Stewart, Kolasch & Birch, LLP

(57) ABSTRACT

A driving method and device for displaying a video signal of a normal mode having an aspect ratio of 4 to 3 in a wide mode LCD device having an aspect ratio of 16 to 9 are provided. The method includes the steps of outputting a source start pulse (SSP) signal; latching pixel data for a black display by using a main clock signal having a short period synchronized to the SSP signal; first skipping data latch during a first transition period of the video signal; latching pixel data corresponding to a normal mode by using a clock signal having a long period, and outputting the latched pixel data; and second skipping data latch during a second transition period of the video signal.

9 Claims, 3 Drawing Sheets

NORMAL MODE DRIVING METHOD IN WIDE MODE LIQUID CRYSTAL DISPLAY DEVICE

This application claims the priority benefit of the Korean Patent Application No. P2002-87783 filed on Dec. 31, 2002, which is hereby incorporated by reference.

BACKGROUND OF THE INVENTION

1. Field of the Invention

The present invention relates to a liquid crystal display (LCD) device, and more particularly to a driving method and device for displaying a video signal of a normal mode having an aspect ratio of 4 to 3 in a wide mode LCD device having an aspect ratio of 16 to 9.

2. Discussion of the Related Art

With development of information society, demands for various display devices increase. Accordingly, many efforts have been made to research and develop various flat display devices such as liquid crystal display (LCD), plasma display panel (PDP), electroluminescent display (ELD), and vacuum fluorescent display (VFD). Some species of the flat display devices are already applied to displays of various equipments.

Among the various flat display devices, the liquid crystal display (LCD) device has been most widely used due to the advantageous characteristics of thinness, lightness in weight, and low power consumption, whereby the LCD device substitutes for Cathode Ray Tube (CRT). In addition to the mobile type LCD devices such as a display for a notebook computer, the LCD devices have been developed for computer monitors and televisions to receive and display broadcasting signals.

In general, an LCD device includes an LCD panel for displaying a picture image, and a driving circuit for applying a driving signal to the LCD panel. The LCD panel is a display device having a liquid crystal injected between two transparent substrates (glass substrates) bonded to each other at a predetermined interval. At this time, one of the two transparent substrates includes a plurality of gate lines arranged in one direction at fixed intervals, a plurality of data lines arranged at fixed intervals for being in perpendicular to the plurality of gate lines, a plurality of pixel electrodes arranged as a matrix type in respective pixel regions defined by the plurality of gate and data lines crossing each other, and a plurality of thin film transistors being switched according to signals of the gate lines for transmitting signals of the data lines to the respective pixel electrodes. The other transparent substrate includes a color filter layer, a common electrode and a black matrix layer. Accordingly, by sequentially applying turn-on signals to the gate lines, data signals are applied to the corresponding pixel electrodes, thereby displaying the picture image.

The general LCD device having the driving circuit will be described with reference the accompanying drawings. FIG. 1 is a block diagram illustrating the driving circuit of the general LCD device. As mentioned above, the driving circuit of the LCD device includes an LCD panel 1 having pixel regions in a matrix type by arranging a plurality of gate G and data D lines crossing each other, a driving circuit part 2 for providing driving and data signals to the LCD panel 1, and a backlight 8 for providing a light source to the LCD panel 1.

The driving circuit part 2 includes a data driver 1*b*, a gate driver 1*a*, a timing controller 3, a power supply part 4, a gamma reference voltage part 5, an AC/DC converter 6 and an inverter 9. At this time, the data driver 1*b* inputs a data signal to each data line of the LCD panel 1, and the gate driver 1*a* applies a gate driving pulse to each gate line of the LCD panel 1. Then, the timing controller 3 receives display data R/G/B, vertical and horizontal synchronized signals VSY and HSY, a clock signal DCLK and a control signal DTEN from a driving system 7 of the LCD panel, and formats the display data, the clock signal and the control signal at a timing suitable for restoring a picture image by the gate driver 1*a* and the data driver 1*b* of the LCD panel 1. Also, the gamma reference voltage part 5 receives power from the power supply part 4 to provide a reference voltage required when digital data input from the data driver 1*b* is converted to analog data. The AC/DC converter 6 outputs a constant voltage $V_{DD}$, a gate high voltage $V_{GH}$, a gate low voltage $V_{GL}$, a reference voltage $V_{ref}$, and a common voltage Vcom for the LCD panel 1 by using a voltage output from the power supply part 4. Also, the inverter 9 drives the backlight 8.

An operation of the general LCD device in FIG. 1 will be described as follows. The timing controller 3 receives the display data R/G/B, the vertical and horizontal synchronous signals Vsync and Hsync, the clock signal DCLK and the control signal DTEN from the driving system PC 7 of the LCD panel, and provides the display data, the clock signal and the control signal formatted at the timing suitable for restoring the picture image by the data driver 1*b* and the gate driver 1*a* of the LCD panel 1. That is, the gate driver 1*a* applies the gate driving pulse to each gate line of the LCD panel 1, and the synchronous data driver 1*b* inputs the data signal to each data line of the LCD panel 1, thereby displaying the input picture image. At this time, the backlight 8 provides constant brightness without relation to the luminance of the input image signal.

As technology develops, the LCD device is used for a display device of a television requiring a rapid response time. Furthermore, a wide mode LCD device having an aspect ratio of 16 to 9 is being actively studied. The wide mode LCD device has a horizontal axis longer than that of the normal mode LCD device having the aspect ratio of 4 to 3. That is, in order to drive the normal mode image signal in the wide mode LCD device, black display is generated at the left and right sides of the display device.

A general driving method for displaying the normal mode image signal in the wide mode LCD device will be described as follows.

FIG. 2 is a timing view illustrating an analog normal mode driving method used in a general wide mode LCD device according to the related art. For example, in case a wide mode LCD device having a resolution of 1440×234 (the number of gate lines=234, the number of data lines=1440) receives a broadcasting signal used in Korea, an image signal of National Television Standard Committee (NTSC) method, a display method will be described as follows. In the LCD device having the resolution of 1440×234, one pixel is operated by three data lines R, G and B, and the number of pixels substantially operated is 480×234. Accordingly, in order to drive the normal mode image signal in the wide mode LCD device of which one line has 480 pixels, black display is generated at the left and right sides of the display device, in which about 60 pixels are displayed as black.

As shown in FIG. 2, one horizontal block (63.5 μs) of an analog image signal of the NTSC method includes a horizontal front porch 1.5 μs, a horizontal synchronous width (4.7 μs), a horizontal back porch (4.7 μs), and an active data period (52.6 μs). The horizontal front porch 1.5 μs indicates a time period from the active data of a preceding horizontal block (last pixel data of one line) to the falling edge of the horizontal synchronous signal HSY. The horizontal back porch 4.7 μs indicates a time period from the rising edge of the horizontal start pulse HSP to the start of the active data.

When displaying the broadcasting signal in the wide mode LCD device as the wide mode, the timing controller 3 divides the main clock signal 104.8 ns into two main clock signals as 52.4 ns, thereby outputting a source sampling clock SSC signal (latching the image data according to its rising or falling edge). Also, a source start pulse SSP (informing a data start point (a first pixel) in one horizontal block) is output to be positioned at a start point of a valid data block, so that 480 pixels of data are latched at the same clock signal, thereby outputting valid analog data for 50.3 μs. That is, the horizontal start pulse HSP is output with its falling edge synchronized with the rising edge of the horizontal synchronized signal HSY. The SSP is output after 6.28 μs (52.4 ns*60) from the rising edge of the horizontal start pulse HSP, thereby driving 480 pixels.

When displaying the broadcasting signal in the wide mode LCD device as the normal mode, the SSP is output such that the falling edge of the SSP is synchronized with the end of the horizontal back porch. In this regard, the start and end points of the active data region in one horizontal block are displayed abnormally, whereas the rest portions are displayed normally. By using a main clock signal (52.4 ns) input at the SSP start point, the image is abnormally displayed during a time period 3.14 μs (52.4 ns*60) corresponding to 60 pixels. Then subsequent 360 pixels are latched to the clock signal of 139.73 ns, and the valid analog data is output during 50.3 μs. Then, the data of subsequent 60 pixels is abnormally displayed for a time period of 3.14 μs by using the main clock signal (52.4 ns) again.

However, the driving method for displaying the normal mode image signal in the wide mode LCD device according to the related art has the following disadvantages.

In case of displaying the normal mode image signal in the wide mode LCD device, as mentioned above, specific pixels (60 pixels) are abnormally displayed at the start and end points of the active data region. But, the black display is not generated in the block having a transition area TA in the video signal since the beginning 60 pixel data is latched not to the back porch portion of the signal receiving the black data, but is latched to the transition area TA of the video signal. As a result, an undesired picture data is applied. This displays undesired lines and not the black display on the displayed screen. As a result, the picture quality is deteriorated.

SUMMARY OF THE INVENTION

Accordingly, the present invention is directed to a normal mode driving method in a wide mode LCD device that substantially obviates one or more problems due to limitations and disadvantages of the related art.

An object of the present invention is to provide a normal mode driving method and device in a wide mode LCD device, so that it is possible to prevent lines from being displayed in the black display region when displaying an image as a normal mode.

Additional advantages, objects, and features of the invention will be set forth in part in the description which follows and in part will become apparent to those having ordinary skill in the art upon examination of the following or may be learned from practice of the invention. The objectives and other advantages of the invention may be realized and attained by the structure particularly pointed out in the written description and claims hereof as well as the appended drawings.

To achieve these objects and other advantages and in accordance with the purpose of the invention, as embodied and broadly described herein, there is provided a driving method for displaying a normal mode signal in a wide mode liquid crystal display (LCD) device, for displaying an analog video signal input to the wide mode LCD device as a normal mode, the method comprising: outputting a source start pulse (SSP) signal; latching pixel data for a black display by using a main clock signal having a short period synchronized to the SSP signal; first skipping data latch during a first transition period of the video signal; latching pixel data corresponding to a normal mode by using a clock signal having a long period, and outputting the latched pixel data; and second skipping data latch during a second transition period of the video signal.

In accordance with another aspect, the present invention provides a method for displaying a video signal in a display device, comprising: generating a source start pulse signal; latching pixel data for a black display from a start of the source start pulse signal to an end of a back porch of a clock signal; and skipping latch of subsequent pixel data during a transition period of the video signal.

In accordance with another aspect, the present invention provides a driving device for displaying a video signal in a display device, including a combination of elements for: generating a source start pulse signal, latching pixel data for a black display from a start of the source start pulse signal to an end of a back porch of a clock signal, and skipping latch of subsequent pixel data during a transition period of the video signal.

It is to be understood that both the foregoing general description and the following detailed description of the present invention are exemplary and explanatory and are intended to provide further explanation of the invention as claimed.

BRIEF DESCRIPTION OF THE DRAWINGS

The accompanying drawings, which are included to provide a further understanding of the invention and are incorporated in and constitute a part of this application, illustrate embodiment(s) of the invention and together with the description serve to explain the principle of the invention. In the drawings.

DETAILED DESCRIPTION OF THE PREFERRED EMBODIMENTS

Reference will now be made in detail to the preferred embodiments of the present invention, examples of which are illustrated in the accompanying drawings. Wherever possible, the same reference numbers will be used throughout the drawings to refer to the same or like parts.

Hereinafter, a driving method and device for displaying a normal mode signal in a wide mode LCD device according to the present invention will be described with reference to the accompanying drawings.

Figure 3:
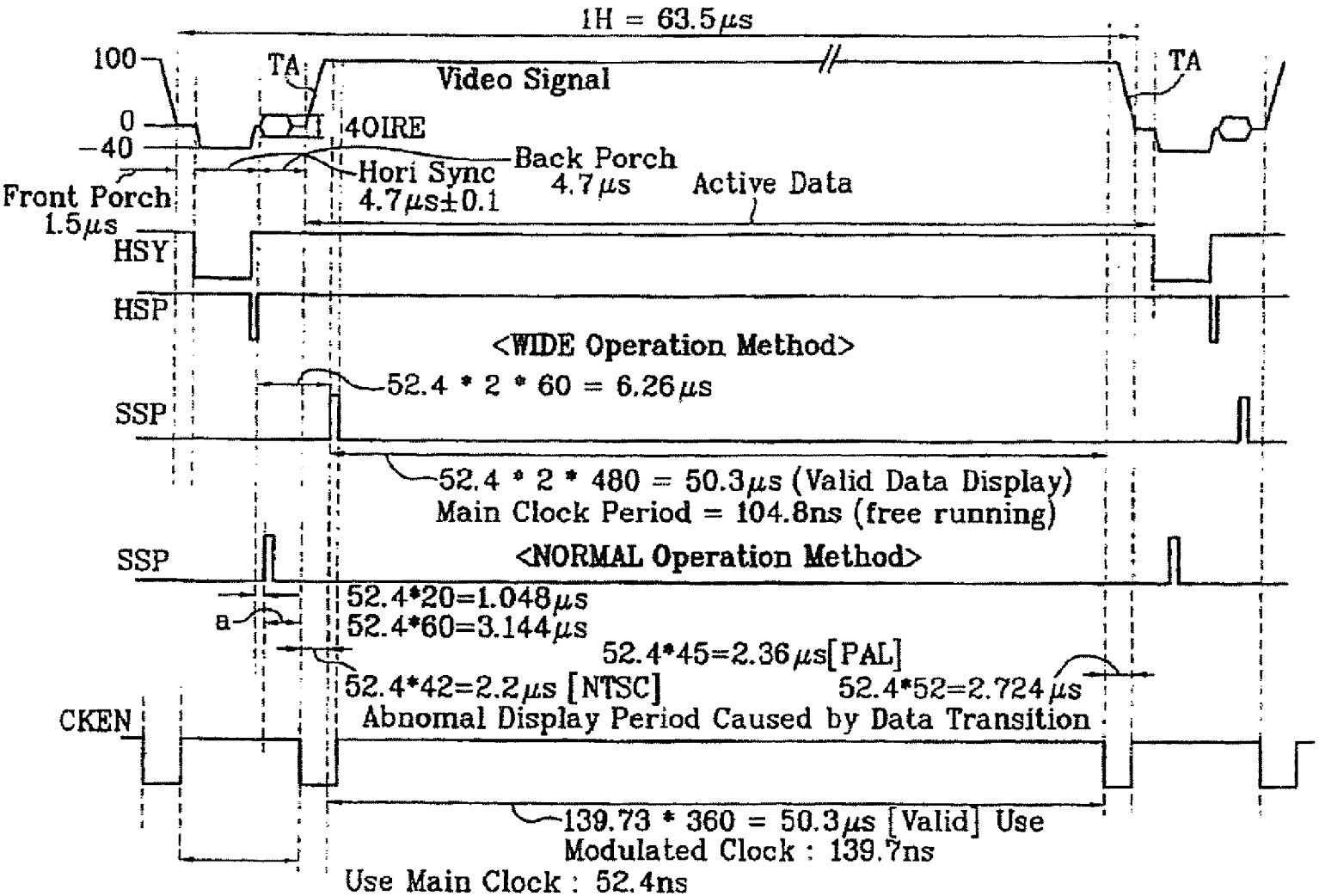
FIG. 3 is a timing view illustrating an analog normal mode driving method in a wide mode LCD device according to a preferred embodiment of the present invention.

FIG. 3 is a timing view illustrating an analog normal mode driving method in a wide mode LCD device according to the present invention.

Figure 1:
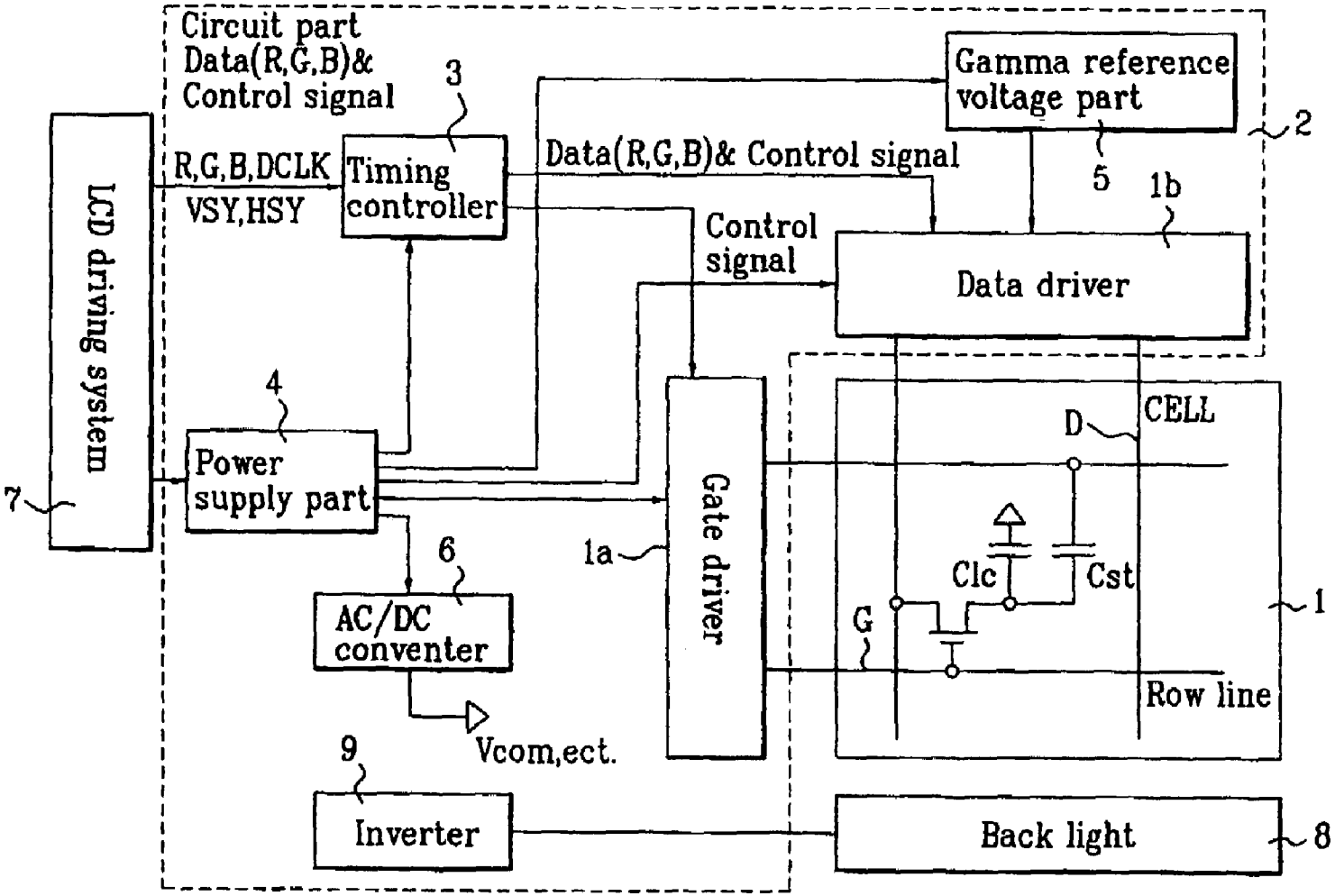
FIG. 1 is a block diagram illustrating a driving circuit of an LCD device to which an analog mode driving method of the present invention is applicable.

The present method is implementable using the device of FIG. 1 or other suitable devices. Particularly, the driving circuit of an LCD device according to the present invention has a similar structure as the driving circuit of a general LCD device. However, the timing controller of the LCD device according to the present invention is operated in a different method from that according to the related art. Accordingly, an additional explanation for the driving circuit of the present invention will be omitted. Also, in order to describe a driving method for displaying the normal mode image in the wide mode LCD device according to the present invention, an image signal and a resolution of the wide mode LCD device will be set in the same conditions as those of the related art.

First, the driving method for displaying a wide mode image in a wide mode LCD device according to the present invention will be described as follows. As shown in FIG. 3, the timing controller 3 (in FIG. 1) divides an input main clock signal 104.8 ns into two as 52.4 ns, thereby outputting a source sampling clock SSC (latching image data according to its rising or falling edge). Also, a source start pulse SSP signal (informing a data start point (a first pixel) in one horizontal block) is output to be positioned at a start point of a valid data block, so that 480 pixels are latched at the same clock, thereby outputting valid analog data for 50.3 μs.

Figure 2:
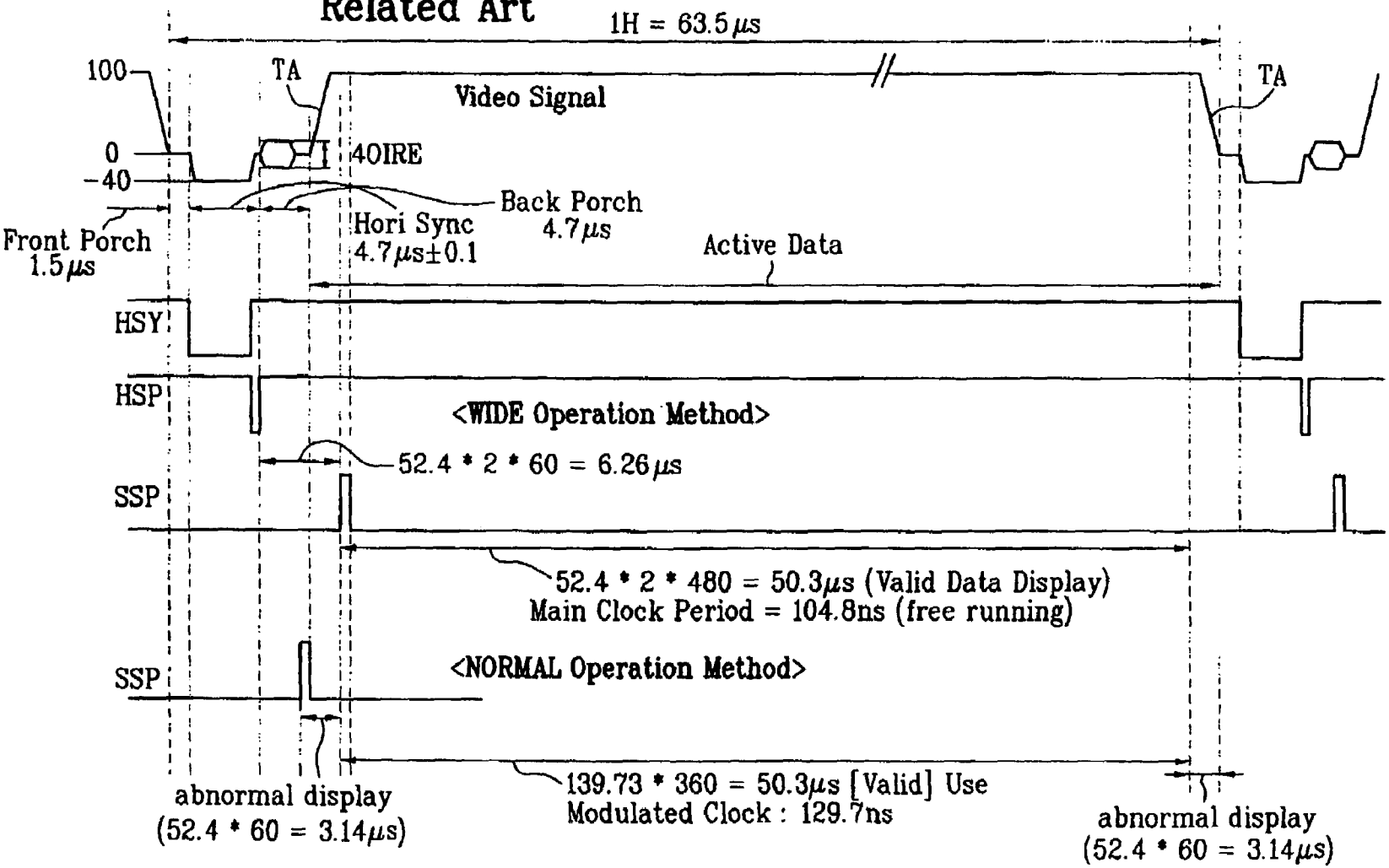
FIG.2 Related Art
FIG. 2 is a timing view illustrating an analog normal mode driving method in a wide mode LCD device according to a related art.

Next, the driving method for displaying a normal mode image in a wide mode LCD device according to the present invention will be described as follows. In the related art, the SSP signal is output such that its falling edge is synchronized to the end of a horizontal back porch as shown in FIG. 2. But, in the present invention as shown in FIG. 3, the SSP signal is output after 1.048 μs (52.4 ns*20) from the rising edge of the horizontal start pulse HSP. That is, the rising edge of the SSP signal is synchronized with the rising edge of the HSP signal (or the start of the back porch). Also, in order to output black color on the left and right sides of a screen among the input analog video signals, the data of 60 pixels is latched in a short section (a) of the back porch receiving the black data by using the main clock signal 52.4 μs when the SSP signal (the rising edge) is output. Then, a clock enable signal CKEN is disabled at a point of a transition TA in the image (video) signal, whereby data latch is skipped forcibly. At this time, in case the video signal is a NTSC analog broadcasting signal, the data latch is skipped for 2.2 μs (52.4 ns*42) corresponding to 42 pixels at the transition area TA of the video signal. Meanwhile, in case the video signal is a PAL analog broadcasting signal, the data latch is skipped for 2.36 μs (52.4 ns*45) corresponding to 45 pixels.

In the valid data input section, 360 pixel data is latched by using a clock signal (139.7 ns) having a long period, so that the valid data is output for 50.3 μs. The CKEN is then disabled again at the transition area TA of the video signal, whereby the data latch is skipped forcibly at the end of the video signal. In the black data input section, 60 pixel data is latched with a main clock signal (52.4 ns). In case of displaying the normal mode image in the wide mode LCD device according to the aforementioned method, it is thus possible to generate perfect black display at the left and right sides of the screen, because the beginning 60 pixel data is latched at a short section (a) of the back porch receiving the black data for displaying the black image.

As mentioned above, the driving method and device for displaying the normal mode image in the wide mode LCD device according to the present invention has the following advantages.

In case of displaying the normal mode image in the wide mode LCD device according to the present invention, 60 pixel data is latched in the short section of the back porch, to which the black data is input, by using the main clock signal (52.4 ns) when the SSP is output, and the CKEN is disabled at the transition area(s) of the image signal to forcibly skip the data latch during that time. As a result, the black display is accurately generated at the left and right sides of the LCD panel, thereby improving the picture quality greatly.

It will be apparent to those skilled in the art that various modifications and variations can be made in the present invention. Thus, it is intended that the present invention covers the modifications and variations of this invention provided they come within the scope of the appended claims and their equivalents.

What is claimed is:

1. A driving method for displaying a normal mode signal in a wide mode liquid crystal display (LCD) device, for displaying an analog video signal having a horizontal back porch input to the wide mode LCD device as a normal mode, the method comprising:

outputting a source start pulse (SSP) signal;

latching pixel data for a black display by using a main clock signal having a first period synchronized to the SSP signal;

first skipping latch of the pixel data for the black display during a first transition period of the video signal by using a clock enable signal disabled at the first transition period of the video signal;

latching pixel data corresponding to a normal mode by using a modulated clock signal having a second period that is longer than the first period, and outputting the latched pixel data; and second skipping latch of the pixel data corresponding to a normal mode during a second transition period of the video signal by using the clock enable signal disabled at the second transition period of the video signal.

2. The driving method of claim 1, wherein in the outputting step, the SSP signal is output after a predetermined time period from a horizontal start pulse (HSP).

3. The driving method of claim 2, wherein the predetermined time period is 1.048 μs.

4. The driving method of claim 2, wherein in the outputting step, the SSP signal is output after a certain time period from a rising edge of the HSP.

5. The driving method of claim 1, wherein in the first skipping step, the data latch corresponding to 42 to 45 pixels is skipped.

6. The driving method of claim 1, wherein in the second skipping step, the data latch corresponding to 52 pixels is skipped.

7. The driving method of claim 1, wherein the first period of the clock signal lasts from a start of the SSP signal to an end of the horizontal back porch.

8. The driving method of claim 1, wherein at least one of the first and second skipping steps is performed by disenabling an enable clock signal.

9. The driving method of claim 1, wherein the long period of the clock signal corresponds to 50.3 μs.

* * * * *